US006309199B1

(12) United States Patent
Devine

(10) Patent No.: US 6,309,199 B1
(45) Date of Patent: Oct. 30, 2001

(54) ASSEMBLIES FOR MODULAR FLUID PUMP

(75) Inventor: Theodore G. Devine, Consort (CA)

(73) Assignee: T & E Oils Ltd., Consort (CA)

( * ) Notice: Subject to any disclaimer, the term of this patent is extended or adjusted under 35 U.S.C. 154(b) by 0 days.

(21) Appl. No.: 09/584,024

(22) Filed: May 30, 2000

(30) Foreign Application Priority Data

May 24, 2000 (CA) ..... 2309238

(51) Int. Cl.[7] ..... F04C 2/18; F04C 15/00
(52) U.S. Cl. ..... 418/104; 418/206.6; 418/206.7
(58) Field of Search ..... 418/104, 206.6, 418/206.7; 384/275, 542

(56) References Cited

U.S. PATENT DOCUMENTS 3,059,835 * 10/1962 Hanley et al. ..... 418/206.7
3,392,677 * 7/1968 Kennedy ..... 418/104

FOREIGN PATENT DOCUMENTS 2021157 1/1991 (CA) .
2226693 8/1998 (CA) .
2246100 3/1999 (CA) .
4024067 * 1/1992 (DE) .

OTHER PUBLICATIONS

Roper Pumps, Bulletin 70–25, Series 3600–3700 4600–4700, Published Oct. 1987, U.S.A.

* cited by examiner

*Primary Examiner*—John J. Vrablik
(74) *Attorney, Agent, or Firm*—Blake, Cassels & Graydon LLP; Terry L. Leier

(57) ABSTRACT

Discloses apparatus for use with a modular fluid pump assembly, particularly pumps used to pump fluids containing entrained contaminants such as grit. The apparatus includes a pair of removable end plates attachable to a modular pump housing. A bearing assembly is detachably mountable on the exterior of the and plate and provides a cavity to receive a pump shaft fitted with a shaft seal and shaft bearing. A grit collar to surround the pump shaft is mountable on the interior side of the end plate. Replacement of the pump seals or bearings can be effected by removing the bearing assembly. More extensive maintenance, such, as replacement of the grit collar or pump gear or shaft, can be effected by removing the end plates.

4 Claims, 3 Drawing Sheets

ASSEMBLIES FOR MODULAR FLUID PUMP

This invention relates to pump assemblies and to apparatus for modular liquid pump assemblies and more particularly to pump assemblies for pumps adapted for pumping contaminated liquids.

BACKGROUND OF THE INVENTION

Fluid pumps adapted for use in pumping liquids and fluids, such as oils and distillates produced from oil wells, frequently contain entrained contaminating materials such as sand, grit and the like. The pumping of such fluids results in the entrained gritty materials that are found in the fluid to come into contact with the pump elements, in particular, the pump surface elements as well as the pump bearings and seals. Where large volumes of fluid are pumped or a pump is used frequently, such as to empty a holding tank near the well site, the pump mechanical elements are exposed routinely to the entrained gritty materials. Consequently, pumps in service for such tasks have a tendency to wear prematurely and fail after a short period of use, such as after a few months or less than one year.

In the past, modular pump assemblies have been proposed to provide double fluid seals such as that disclosed by Korenblit in Canadian patent 2,021,157 which provides tandem mounted face seals each having a different construction, that is a flexible seal and a non-flexible seal to improve seal performance. Another seal arrangement is shown by Ernens in published Canadian patent application 2,226,693. The seal arrangement of Ernens situates the seals between the pump rotor and bearings. A high pressure hydraulic system and pump including high pressure seals at both ends of the pump driven shaft to reduce or eliminate forces that might tend to increase friction and wear is disclosed in published Canadian patent application 2,246,100 by Tieben.

However, to improve the serviceability of pumps and the increase the operating life of pumps put to uses involving pumping fluids containing grit materials, such as pumping field holding tanks of oil wells and the like, other pump assemblies are needed than have heretofore been provided. It is an object of this invention to provide a apparatus for modular pumps that provides for ease of maintenance and parts replacement of pump parts to decrease the cost of pump maintenance and to improve the life expectancy of the pump assembly.

SUMMARY OF THE INVENTION

In one of its aspects, the invention provides apparatus for a modular pump assembly that includes easy accessibility to replaceable seals and bearings with modular end plate assemblies to allow servicing with a minimum of parts required to be replaced.

The pump is provided with a housing including multi-part removable end plates that facilitate access to pump seals and bearings as well as entry into the pump cavities to replace the pump elements. The multi-part removable end plates include removable bearing assemblies that permit the pump bearings to be accessed to replaced or the pump seals to be replaced without requiring disassembly of the entire pump housing and pump cavity assembly.

In one of its aspects, the invention provides modular pump apparatus for a modular fluid pump including a pair of end plates adapted to be removably sealingly attachable to a modular pump housing, each end-plate forming at least one shaft passage to receive a pump shaft therethrough. Each shaft passage in the endplate has a bearing mount provided on the outer side of the endplate for attachment of at least one bearing assembly, and a grit collar mount on the inner side of the endplate. The modular pump apparatus further includes at least one bearing assembly dimensioned to fit on to the bearing mount. The bearing mount forms a cavity to receive a pump shaft fitted with a shaft seal and a shaft bearing and means to releasably secure the bearing assembly to the endplate. A grit collar, adapted to receive a pump shaft therethrough, is mountable in the grit collar mount of the endplate.

Other aspects of the invention will appear from the following description and appended claims. The invention will now be explained with reference to the accompanying drawings in which like reference numerals have been used throughout the various figures of the drawings:

DETAILED DESCRIPTION OF THE PREFERRED EMBODIMENT

Figure 1:
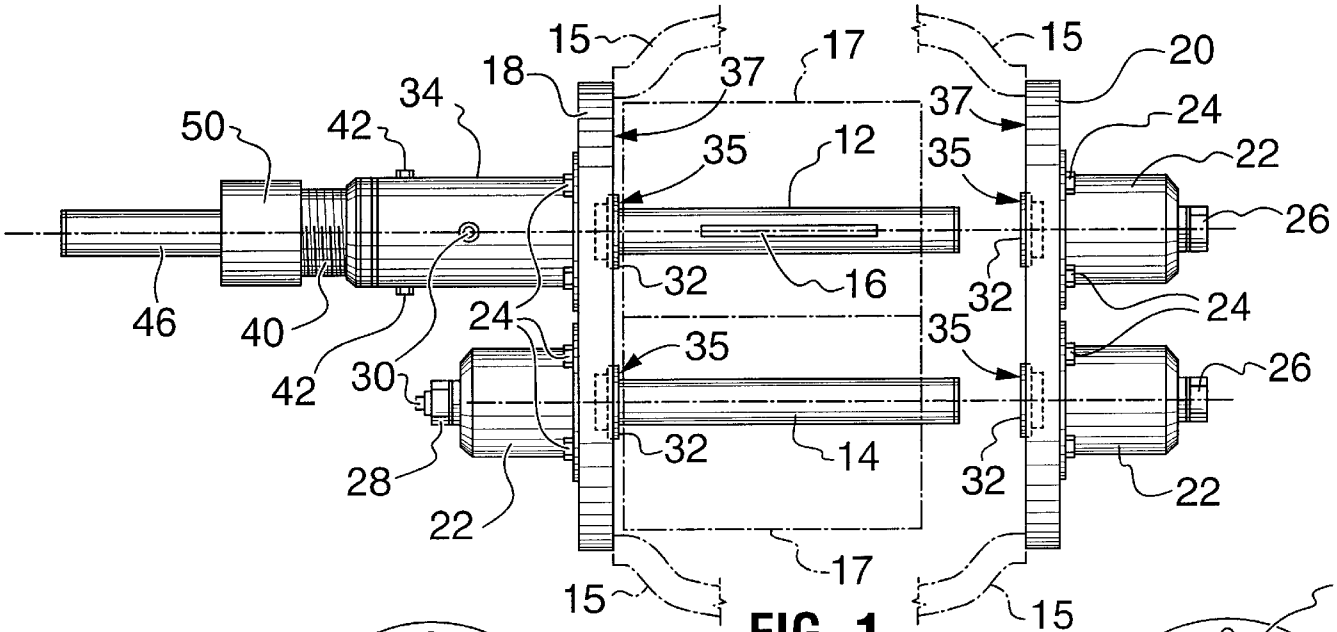
FIG. 1 is a side elevation view of the preferred embodiment of the modular pump assembly, but not including the pump gears and pump cavity housing for clarity.

FIG. 1 shows a side elevation view of the preferred embodiment of the modular pump assembly. The drive elements of the modular pump, such as a helical two gear pump, are shown in FIG. 1, but, for clarity the pump drive gears 17 and only a portion of the pump housing are shown in dotted outline form in the figure. A drive shaft 12 provides rotating support for a first gear 17 and the idler shaft 14 provides rotating support for a second pump gear 17 spacedly disposed from the first. Each of these gears 17 is disposed within the pump housing 15 and between side endplate 18 and 20. Sealingly attached to the pump housing 15 to seal the pump cavity formed in the pump housing in the pump gears 17 operate to pump the fluid to be pumped. Fluids to be pumped are captured between the teeth of the gears 17 that are mounted on drive shaft 12 and counter-rotating idler shaft 14 to cause the fluid to be pumped through the cavity formed in the pump housing 15 of the pump. Drive shaft 12 includes a keyway slot 16 to provide a rotational coupling to the driven gear 17 of the pump. Sealingly disposed on either side of the pump cavity on the exterior of the pump housing 15 are end plates 18 and 20. Preferably, both end plates 18 and 20 are the same configuration to reduce parts overhead. However, it will be understood by those skilled in the art that the drive side end plate 18 can be dimensioned to meet the requirements for mounting the end plate on the housing and can be of a different shape and dimension than idler side end plate 20 if so required by the design and construction of the pump housing. As shown most clearly in FIGS. 2 and 3, each end plate 10 and 20 has a number of peripherally disposed fastener mounts 19 which are used to attach the end plates 18 and 20 to the pump housing 15. Fastener mounts 19 are preferably holes though which bolts can pass to secure the end plates 18 and 20 to the pump housing 15.

Figure 3:
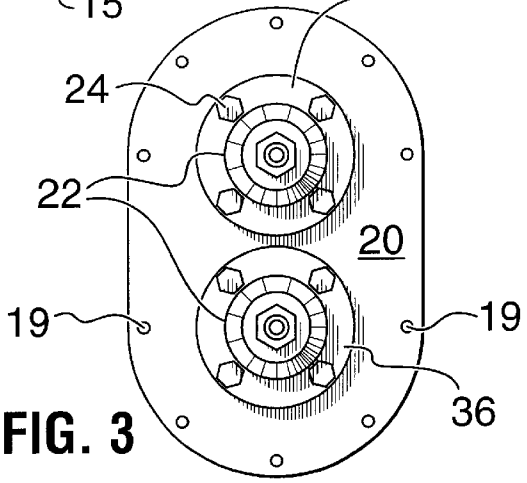
FIG. 3 is an elevation view of the pump assembly idler shaft assembly of the apparatus of FIG. 1.
Figure 2:
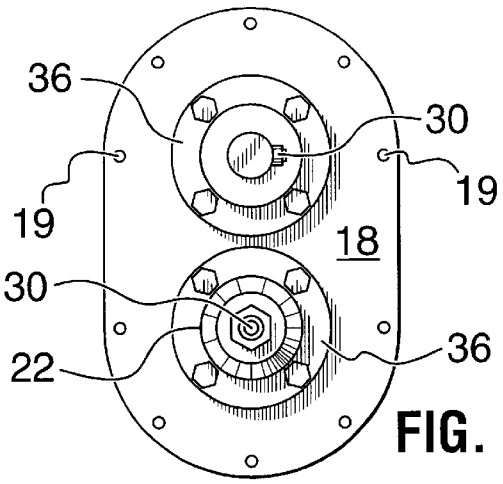
FIG. 2 is an elevation view of the pump assembly drive shaft apparatus of FIG. 1.

In the preferred embodiment depicted in FIGS. 1, 2 and 3, end plates 18 and 20 share a common design. Affixed to end plate 20 are cups forming bearing assemblies 22. Preferably, bearing assemblies 22 are removably affixed to the end plate by means of bolts 24. Provided at the distal end of bearing assembly 22 is an end bolt, either 26 or 28. End bolt 28 is interchangeable with end bolt 26 and end bolt 28 includes a mount for a grease zerk 30, while end bolt 26 has no such grease zerk 30 mount. Grease zerk 30 is coupled to a pressure greaser to apply grease to the bearings of the pump. Shown in dotted outline form in FIG. 1 are grit collars 32 which are dimensioned to slidingly receive the respective drive shafts 12 or 14 therethrough. Preferably grit collar 32 is constructed from bronze and disposed on a mount provided in end plates 18 and 20. Preferably grit collar 32 is frictionally engaged in a mounting recess provided in end plates 18 and 20. Grit collar 32 prevents larger debris entrained in the fluid being pumped, such as sand, grit and the like, from coming into contact with the seals and bearings held within the bearing cup bearing assembly 22. Drive bearing assembly 34 for the drive shaft preferably includes a grease zerk 30 as well to permit grease to be applied to the bearing of the driven shaft of the pump. In the preferred embodiment, surrounding bearing assembly 22 is a hold down ring 36. Hold down ring 36 is dimensioned to slide over the exterior of bearing assembly 22 or 34 but interferingly fit with or against protrusion 38 circumferentially extending around bearing assembly 22 and driver bearing assembly 34. In this way, bearing assembly 22 or drive bearing assembly cup 34 can be releasably retained against end plates 18 or 20 when the hold down ring 36 is bolted to the respective end plate with bolts 24. When service of the pump seals or bearings is required, to replace them for example, all that is needed to gain access to the bearings or seals is to remove the bearing assembly 22 from the end plate 18 or 20 by undoing bolts 24. It is not necessary to undo or remove the end plates 18 or 20 themselves from the pump assembly for this servicing.

Preferably grit collar 32 is constructed with a shoulder 33 to provide a thrust surface 35 elevated or projecting upwardly from the surrounding surface 37 of the interior facing side of end plates 18 and 20. This thrust surface provides a lateral or axial stop for the rotating pump elements, such as the pump gears 17, and the like. With such a thrust surface, the rotating pump elements will tend not to wear the end plates as quickly and grit collars 30 can the replaced as needed to increase the service life of endplates 18 and 20.

Figure 4:
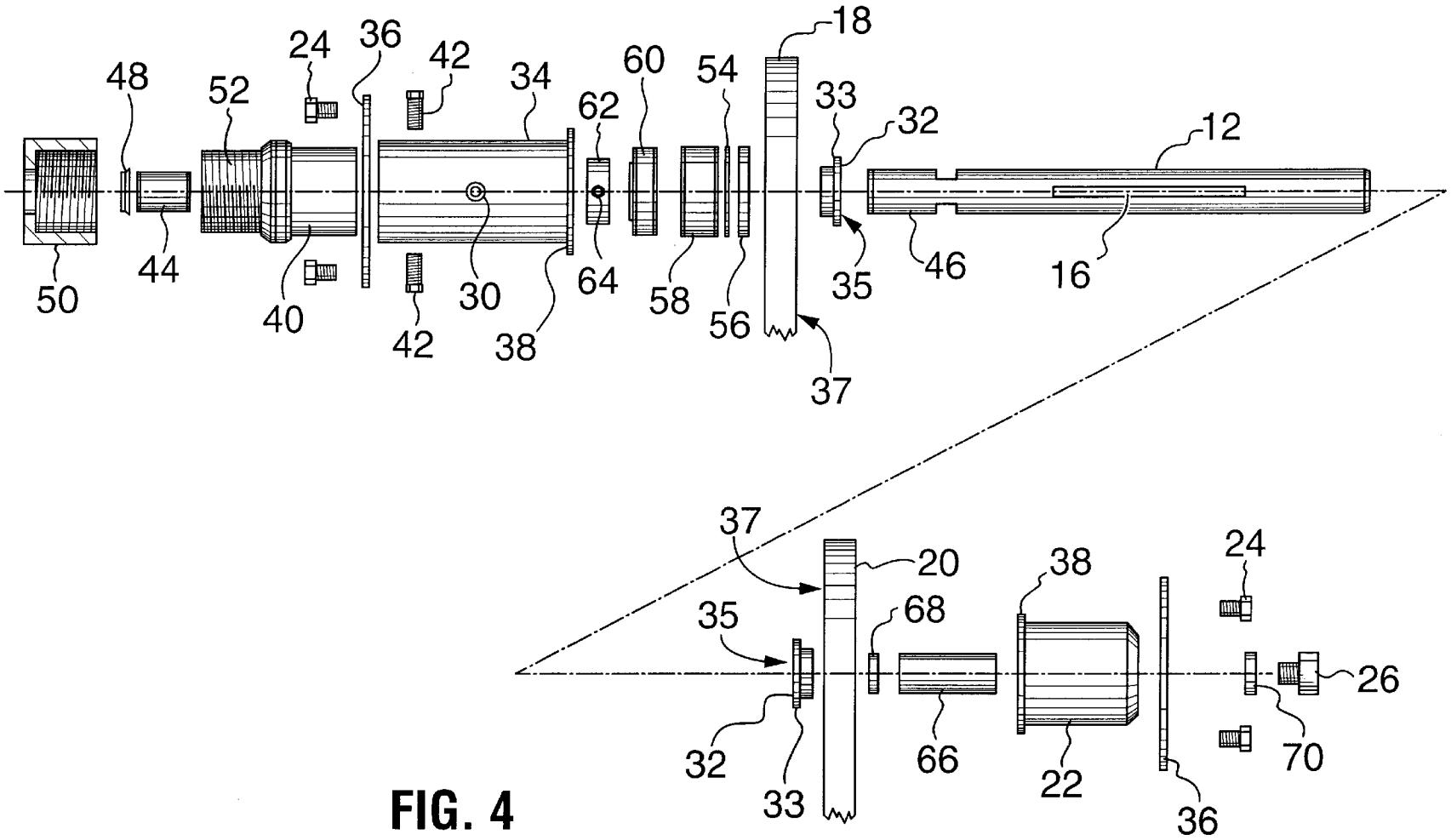
FIG. 4 is an exploded view of the drive shaft assembly of the pump assembly of FIG. 2.

Referring to FIG. 4, the drive shaft bearing assemblies are shown in exploded view for clarity of the modular component construction. The exploded view also shows the component rotational bearings and seals of the drive shaft assembly. Drive bearing assembly 34 has an exterior facing packing nut 40 that is retained within drive bearing assembly 34 by means of bolts 42. Disposed within packing nut 40 is a bearing 44 that provides rotational support of drive shaft 12, which extends therethrough when assembled as depicted in FIG. 1. Preferably bearing 44 is a bronze bushing construction. Bearing 44 provides rotational support proximal to the external protruding end 46 of the drive shaft to facilitate mounting drive couplings, such as pulleys, sprockets or collars on the external protruding end 46 of the drive shaft to couple the pump to a source of rotational power such as a motor. A seal 48, for example an o-ring seal, extends around drive shaft 12 and is adjacent to bearing 44. The bearing 44 and seal 48 are retained within packing nut 40 by means of collar 50 which is preferably threaded onto the exposed end 52 of the packing nut 40. Drive shaft 12 extends through end plate 18 and is sealed with respect to the interior of the pump cavity by means of a seal 54. Seal 54 is retained in place on the interior side portion of end plate 18 using a seal holder 56.

A rotational bearing 58 and thrust bearing 60 are mounted on drive shaft 12 to provide for drive shaft rotational support as well as axial support when the apparatus is in the assembled configuration shown in FIG. 1. Axial or lateral movement of drive shaft 12 is limited by a lock collar 62 which is releasably affixed to drive shaft 12 using a lock nut 64. Lock collar 62 is set at the desired axial or lateral position of drive shaft 12 with respect to end plate 18. Provided on the interior side of end plate 18 is a grit collar 32 which is dimensioned to receive drive shaft 12 therethrough. The opposite end of drive shaft 12 passes through end plate 20 which has grit collar 32 mounted on the side surface thereof. On the exterior side of end plate 20 is bearing assembly 22 into which bearing 66 is received. Bearing 66 provides rotational support for drive shaft 12 and can be serviced or replaced by removing bearing assembly 22 from end plate 20. Bearing assembly 22 is removed from end plate 20 by undoing bolts 24 that secure hold-down ring 36 to the end plate 20.

Fluids from the pump cavity on the interior side of end plate 20, where grit collar 32 is disposed, are kept from contact with bearing 66 by means of seal 68. Preferably bearing 66 is a bronze bushing and seal 68 is an o-ring. To replace seal 68 or bearing 66, or both, all that is required is to loosen bolts 24 and remove hold down ring 36 which will free the bearing assembly 22 from the end of drive shaft 12 permitting access to the bearing 66, and seal 68 for replacement. End bolt 26 is threadingly received in the crown of bearing assembly 22 and may include a seal 70 where bolt 26 is not provided with a tapered pipe thread that will seal mechanically to bearing assembly 22. If desired, end bolt 26 can be replaced by an end bolt 28 which is configured to receive a grease zerk 30. A seal 70 is used when bolt 26 is not a pipe thread, but rather a standard thread. Standard thread is preferable to allow the thread hole to be advantageously used to mount a puller apparatus (not shown).

Figure 5:
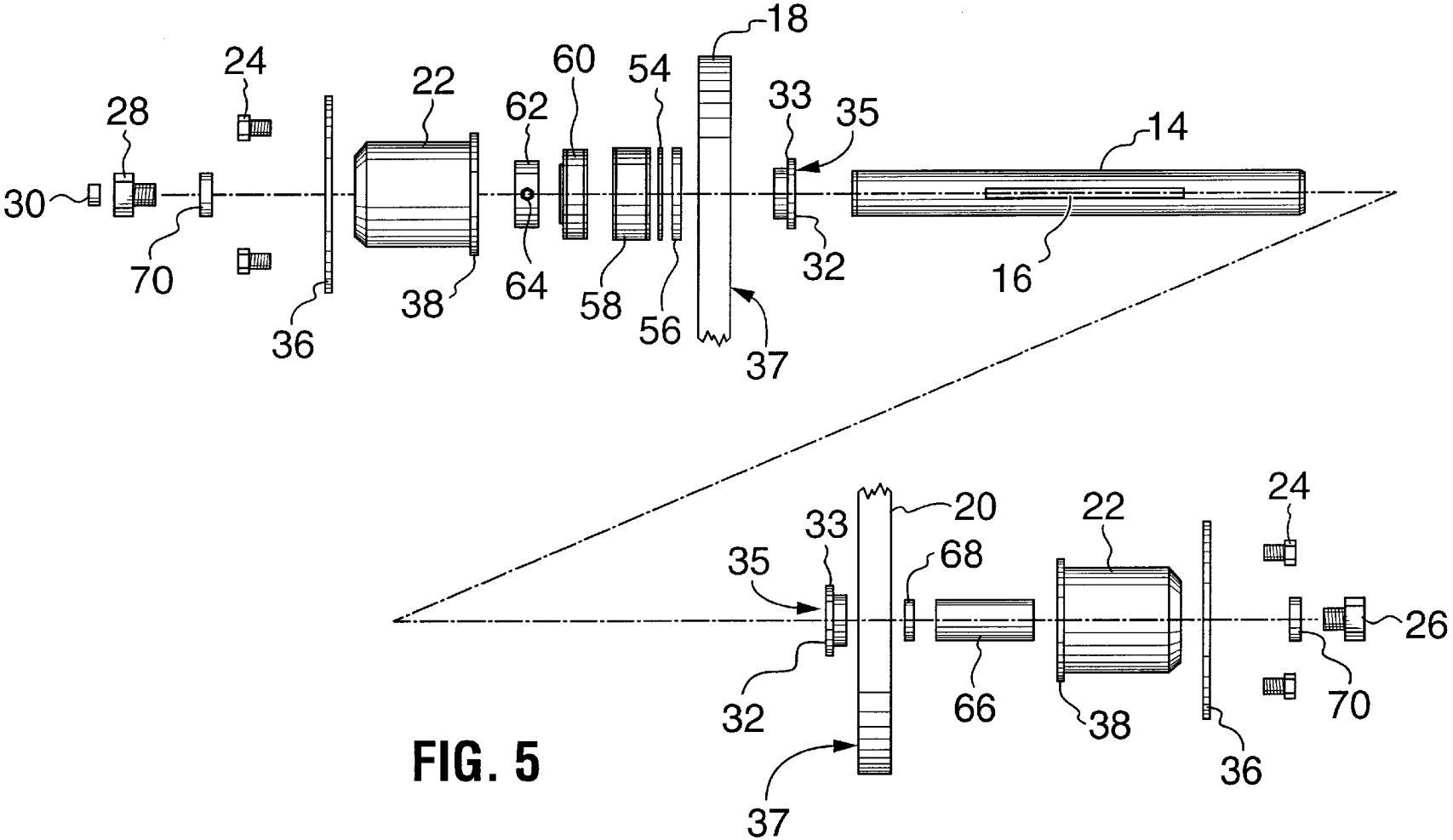
FIG. 5 is an exploded view of the idler shaft assembly of FIG. 3.

Referring to FIG. 5, the idler shaft assembly of FIG. 1 is shown in exploded view. The upper portion of FIG. 5 shows an alternative bearing configuration. The alternate bearing configuration includes a rotational bearing 58 and thrust bearing 60. Idler shaft 14 is maintained in axial or lateral displacement with respect to end plate 18 by means of lock collar 62. Once idler shaft 14 has been positioned with respect to end plate 18, lock collar 62 is affixed to idler shaft 14 by manipulation of lock nut 64. To keep the fluids from the pump cavity from reaching bearings 58 and 60, a seal 54 is provided which is retained in place by means of seal holder 56. Larger materials such as sand, grit and the like are kept away from seal 54 by means of grit collar 32 which is disposed on the opposite side of end plate 18 from bearing assembly 22. Bearing assembly 22 is releasably secured to end plate 18 by means of bolts 24 interacting with hold down ring 36 to secure the bearing assembly 22 to end plate 18 and contain all of the elements 54, 56, 58, 60, 62 and 64 therein. To replace the seals, bearings or seal holder, all that is required is to remove the bearing assembly 22 from the end plate 18. It is not necessary to remove end plate 18 from the pump housing 15. Grease zerk end bolt 28 has a grease zerk 30 mounted therein. If grease zerk end bolt 28 does not have tapered pipe threading, then seal 70 can be used to maintain a sealed configuration of bolt 28 to bearing assembly 22. Grease zerk 30 is used to supply grease to the bearing elements contained within bearing assembly 22. The lower portion of FIG. 5 shows the bearing assembly 22 for the opposite end of idler shaft 14. The apparatus and configuration of the bearing assembly on this end of the idler shaft is preferably the same as the configuration and assembly described with reference to the bearing assembly 22 of FIG. 4 also mounted on end plate 20.

Now that the invention has been described, numerous modifications and substitutions with occur to those skilled in the art within the spirit and scope of the invention as defined in the claims appended hereto.

The preferred embodiments of the invention in which an exclusive property or privilege is claimed are defined as followd:

1. Modular pump apparatus for a fluid pump including:

a. a pair of end plates adapted to be removably sealingly attachable to a modular pump housing, each end plate forming at least one shaft passage to receive a pump shaft therethrough, each said shaft passage having:

I. a bearing mount provided on the outer side of the end plate for attachment of at least one bearing assembly, and II. a grit collar mount on the inner side of said end plate adjacent a rotating pump element mounted on the pump shaft;

b. at least one bearing assembly dimensioned to fit to said bearing mount forming a cavity to receive a pump shaft fitted with a shaft seal and a shaft bearing;

c. means to releasably secure said bearing assembly to said end plate;

d. a grit collar adapted to receive a pump shaft therethrough and mountable in said grit collar mount of said end plate.

2. Apparatus as claimed in claim 1 wherein said grit collar mount is a recess formed in said end plate.

3. The Apparatus as claimed in claim 1 wherein said grit collar forms a thrust surface.

4. Apparatus as claimed in claim 3 wherein said thrust surface is raised in relation tc the inner side of said end plate.

* * * * *